United States Patent [19]

Beckerer, Jr.

[11] 4,095,640

[45] Jun. 20, 1978

[54] BOAT WINDOW

[76] Inventor: Frank S. Beckerer, Jr., 40 Dock Rd., Milford, Conn. 06460

[21] Appl. No.: 765,101

[22] Filed: Feb. 2, 1977

[51] Int. Cl.[2] ..... E06B 3/32

[52] U.S. Cl. ..... 160/92; 49/394; 49/402; 49/479; 49/485; 49/489; 114/178

[58] Field of Search ..... 49/394, 489, 479, 498, 49/485, 402; 114/177, 178; 160/103, 92

[56] References Cited

U.S. PATENT DOCUMENTS

| | | | |
|---|---|---|---|
| 1,364,695 | 1/1921 | Boyan | 160/92 |
| 1,967,456 | 7/1934 | Swedman et al. | 49/489 X |
| 1,995,939 | 3/1935 | Osten | 49/485 X |
| 2,847,724 | 8/1958 | Blood | 160/92 X |
| 3,217,921 | 11/1965 | Frehse | 49/479 X |
| 3,378,958 | 4/1968 | Parks et al. | 49/489 |
| 3,779,198 | 12/1973 | Gray | 114/178 |
| 3,810,483 | 5/1974 | Vonderhaar | 49/479 X |

FOREIGN PATENT DOCUMENTS

| | | | |
|---|---|---|---|
| 696,427 | 9/1953 | United Kingdom | 49/402 |
| 1,411,397 | 10/1975 | United Kingdom | 49/402 |

*Primary Examiner*—Philip C. Kannan

*Attorney, Agent, or Firm*—H. Gibner Lehmann; K. Gibner Lehmann

[57] ABSTRACT

A self-draining, leak-resistant boat window comprising a frame body having a continuous mounting flange for engagement with the hull of the boat, and a spigot wall connected with the flange and adapted to extend through an opening in the hull. A transparent molded plastic window pane is hingedly carried on the body; latches are provided to secure the pane in a closed position. The mounting flange has a peripheral groove into which a rib portion of an extruded, hollow sealing gasket is pressed. The rib portion has longitudinal barbs which frictionally engage the walls of the groove, thereby holding the gasket captive without cement. The gasket is oval in cross-section and is stretched an extent when installed on the window to thereby prevent buckling at the corners. When it is pressed between the flange and window pane it flattens a considerable amount by virtue of its oval shape, forming a tight seal.

Self-draining occurs, by virtue of one part of the spigot wall being sloped, which channels water outward and downward. Water is prevented from being trapped in the space between the spigot and pane, since this area is virtually completely filled by the gasket when it is compressed by the pane.

16 Claims, 11 Drawing Figures

BOAT WINDOW

BACKGROUND

This invention relates generally to boat accessories, and more particularly to boat windows of the type having a transparent window pane hingedly connected to a window frame or body.

Prior window constructions for boats generally employed rubber sealing gaskets around the periphery of a body or frame, adapted to be engaged by corresponding peripheral portions of the window pane when the latter was swung to a closed position and latched in place. Generally such gaskets were secured to the frame by cement or glue, which was usually sufficient to hold the gasket in place at least for a period of time. It has been found that after extended usage, such gaskets tended to deteriorate, and the cement or glue associated therewith would loosen. When this occurred, leakage around the window became a problem, particularly since in prior window constructions, water could become trapped in small pockets around the gasket. Under such circumstances, the trapped water would either leak directly into the cabin or else be released upon the window pane being swung open. In addition, installation of such gaskets was time consuming, involving a curing or setting time for the cement. Many of the materials of which prior gaskets were constructed tended to stick to the window pane, especially if the window was left in the closed position for any appreciable length of time. Even where the gasket material held up, in most prior constructions there still existed a small space around the gasket and between the spigot and the pane, in which water could become trapped. Such spaces usually resulted from idiosyncracies in the molding process involving placement of the mold parting line.

Frequently, such windows employed removable screens, which were held in position by small plastic tabs. Care had to be exercised in assembling such units, since there was a likelihood that the tabs would break off and become lost, thereby defeating the concept of a removable, snap-in screen.

SUMMARY

The above disadvantages and drawbacks of prior boat window constructions are obviated by the present invention, which has for an object the provision of a novel and improved boat window which is simple in construction, reliable in operation and which largely overcomes the problems of leakage due to trapped water as noted above. A related object is the provision of a window which provides improved resistance to leakage over extended periods of use, without the need for complicated seals or complex structures. Still another object is the provision of a window wherein the parts can be constituted of rubber and molded plastic, and in certain cases readily assembled without the use of special glue or cements.

Still another object of the invention is the provision of a window wherein minimal space exists around the window pane and gasket for water to become trapped, and wherein provision is made for automatically and continuously draining such trapped water regardless of the position of the boat.

The above objects are accomplished by the provision of a self-draining, leak-resistant boat window comprising a frame body having a continuous mounting flange for engagement with the hull of the boat, and a spigot wall connected with the flange and adapted to extend through an opening in the hull. A transparent window pane is hingedly carried on the body, and latches are provided to secure the pane in a closed position. The mounting flange has a peripheral groove into which a rib portion of a sealing gasket is pressed. The rib portion has longitudinal barbs which frictionally engage the walls of the groove, thereby holding the gasket captive. The gasket is yieldable and preferably but not necessarily oval in cross-section, being adapted to flatten when it is pressed between the flange and window pane. An especially tight and leak-resistant seal of the window is thus realized, all without resorting to cement, glue, solvents or the like.

In addition, the invention further provides a self-draining feature, by virtue of at least one part of the spigot having a sloping wall, which has the effect of channeling water from the vicinity of the gasket and window pane in an outward direction. In one embodiment, small weep holes in the body also assist in such drainage function.

The arragement is such that the gasket can be readily pressed into the frame and permanently retained therein. Due to the unique yieldable construction of the gasket, excellent sealing characteristics are realized with little deterioration over extended periods of use.

Other features and advantages will hereinafter appear.

In the drawings, illustrating several embodiments of the invention:

Figure 1:
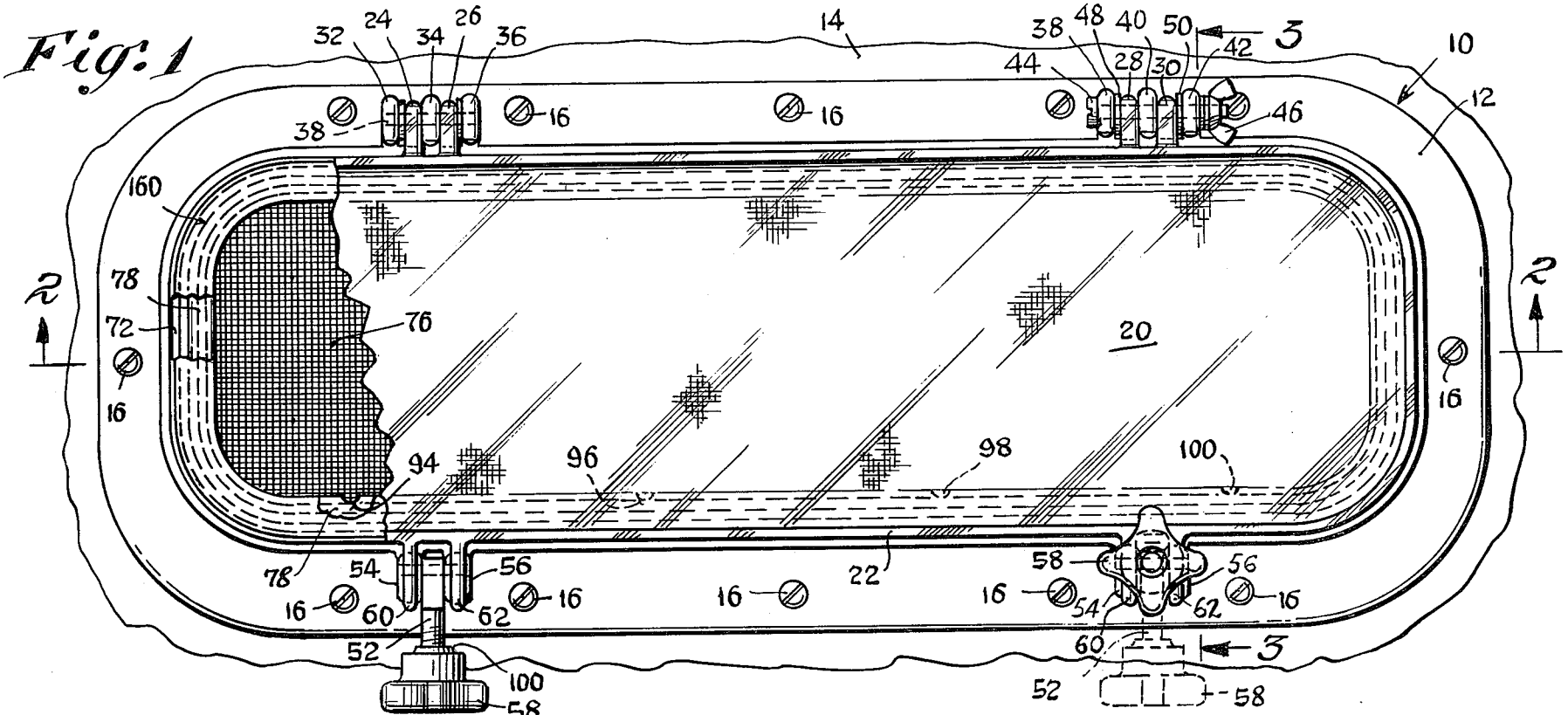
FIG. 1 is a front elevational view, partly broken away, of the improved boat window of the present invention.
Figure 2:
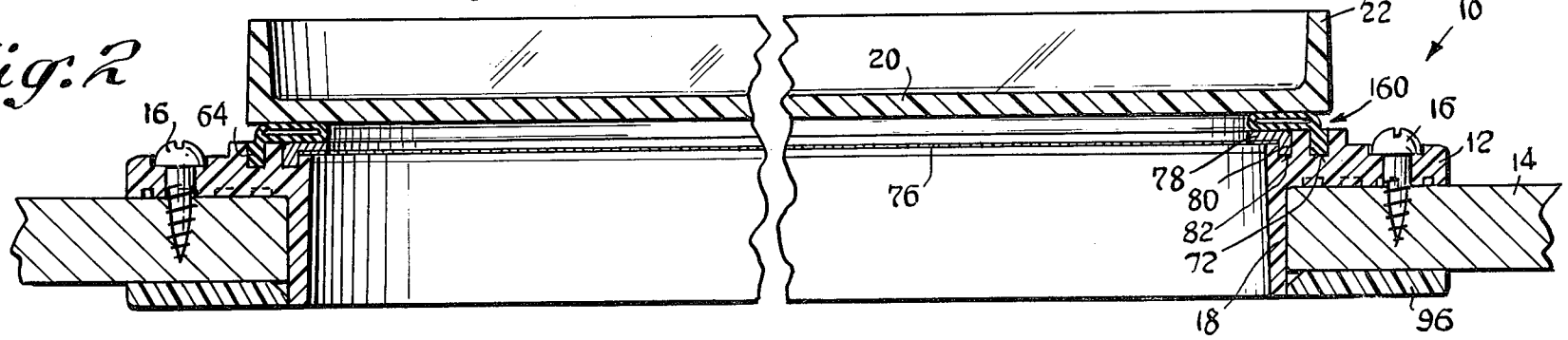
FIG. 2 is a section taken on line 2—2 of FIG. 1.
Figure 3:
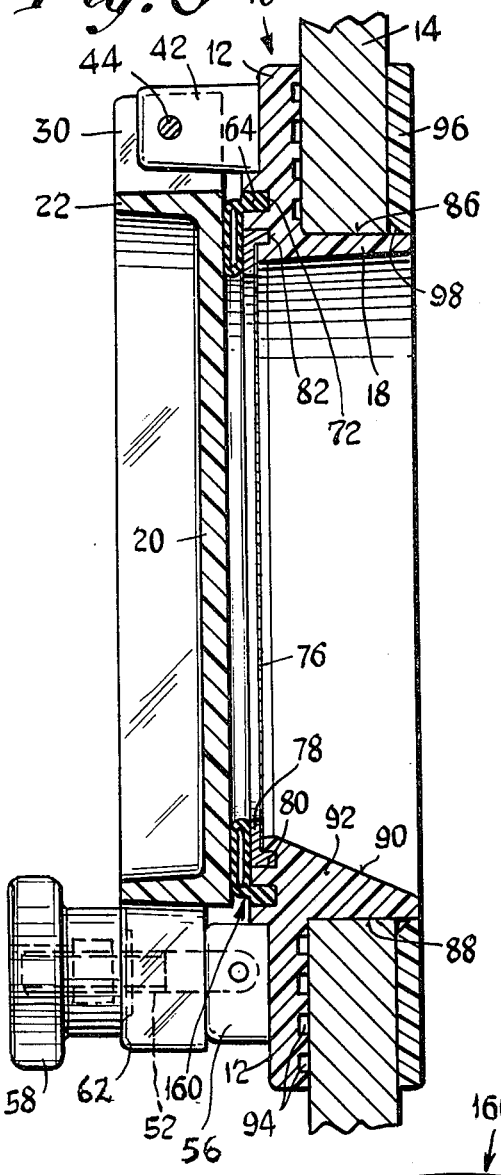
FIG. 3 is a section taken on line 3—3 of FIG. 1.

FIGS. 1–3 show a boat wndow generally designated by the numeral 10, for installation in a suitable porthole or opening of a boat hull. The window construction includes a continuous frame body having a mounting flange 12 which seats against the inner surface of the boat hull 14 as shown in FIG. 2, being secured in place by means of multiple screws 16. The body further includes a spigot or spigot wall 18 connected with the mounting flange and adapted to extend through the opening formed in the hull 14. In the present instance, the flange 12 and spigot 18 are constituted of molded plastic and are formed integral with one another. There is also provided a molded plastic window pane 20, preferably transparent, which is hingedly connected to the mounting flange 12 as shown in FIG. 1. The pane 20 includes a periphera flange portion 22 having a pair of hinge lugs 24, 26 pivotally secured to cooperable hinge lugs 32, 34, 36 by means of a spring-type hinge pin 38. A second air of hinge lugs 28, 30 is pivotally secured to cooperable hinge lugs 38, 40, 42 of the flange 12 by a hinge pin in the form of a screw 44 including a wing nut 46. In addition, two resilient washers 48, 50 are provided, against which adjacent portions of the lugs bear when the wing nut 46 is tightened. Such a construction enables the window to be opened and held in such open position against the action of gravity.

Means are provided on the flange 12 and pane 20 for latching the latter in a closed position wherein the opening formed by the spigot 18 is closed off. As illustrated in FIG. 1, two latches are provided, each comprising a swivel arm 52 carried on a pin extending through aligned lugs 54, 56, the end of the arm 52 being threaded and carrying a knob 58 of molded plastic construction. During the manufacture of this knob 58, a nut is incorporated and held captive, for engagement with the threads of the swivel arm 52. The flange 22 of the pane 20 includes pairs of lugs 60, 62 which are adapted to overlie the lugs 54, 56 when the window is in the closed position of FIG. 1. By such an arrangement, the arm 52 can be swung to a position wherein the know 58 overlies the lugs 60, 62, after which the knob can be tightened on the arm 52 so as to secure the window in a closed position, as in FIG. 3. It will be understood that the left-hand latch mechanism in FIG. 1 is shown in the un-latched position, whereas the right-hand latch mechanism is shown in the latched position, the knob 58 having been tightened.

Figure 6:
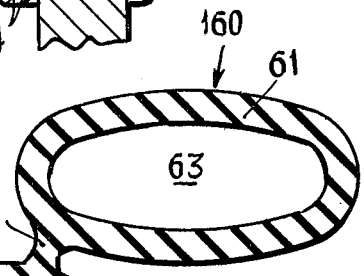
FIG. 6 is a cross-sectional view of the sealing gasket employed in the window construction of FIGS. 1–3.
Figure 7:
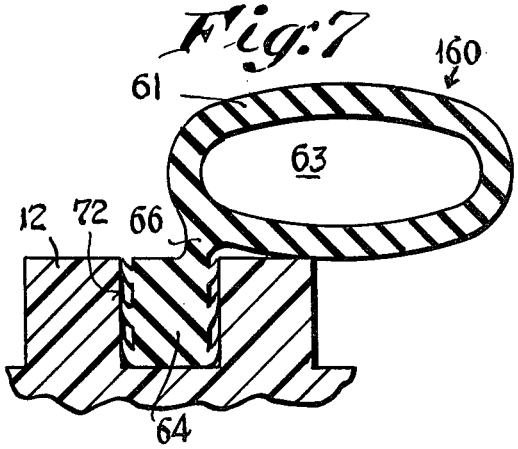
FIG. 7 is a view like FIG. 6, except showing the gasket installed in a peripheral groove of the mounting flange of the window body, and illustrating the flattening of longitudinal barbs associated with the gasket.

In accordance with the present invention, there is provided an especially simple yet effective leak-resistant seal between peripheral portions of the window pane 20 and the adjacent portions of the mounting flange 12. Referring particularly to FIGS. 2, 6 and 7, there is illustrated a novel gasket construction generally designated by the numeral 160. The gasket 160 is resilient and has a portion 61 of generally oval cross-sectional configuration, with an inner space 63. Secured at one edge of the gasket 160 is a protruding rib 64 connected to the oval portion 61 by means of a thin web 66. Disposed on opposite sides of the rib 64 are two series of barbs 68, 70 extending lengthwise thereof. The gasket 160 can be constituted of resilient material similar to that manufactured under the trademark "Nordel," by DuPont.

Figure 8:
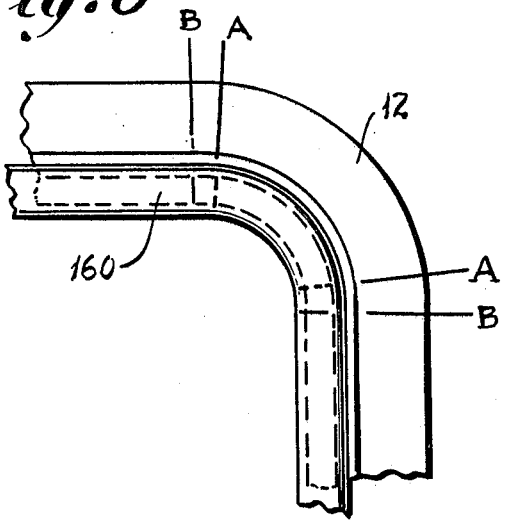
FIG. 8 is a fragmentary front elevational view of the window of FIG. 1, particularly showing the sealing gasket employed therewith, and illustring its stretched condition following installation in the window frame.

As shown in FIGS. 2 and 7, the mounting flange 12 includes a peripheral groove 72 which is adapted to receive the protruding rib 64 of the gasket 160. During such assembly the rib 64 is merely pressed into the groove 72, with the barbs 68, 70 yielding and bending upwardly as shown in FIG. 7, thereby frictionally gripping the opposite walls of the groove 72 and tending to prevent inadvertent removal of the gasket. During manufacture, the gasket is formed by extrusion and cut into predetermined lengths of the proper size, and the ends joined together into a continuous loop by suitable cement. The gasket loop is then installed on the mounting flange 12 such that it surrounds the rectangular window opening, as in FIGS. 1 and 2. I have found that by reducing the length of the gasket, and thereafter requiring it to be stretched an extent when installed on the window, the tendency of the gasket to buckle at the corners of the mounting flange 12 is virtually eliminated. As an example, I have found that in a window having a groove 72 with a 36 ½ inch periphery, a satisfactory unstretched circumference for a gasket loop has been found to be 34 ¼ inches. During installation, the stretching of the gasket is diagrammatically illustrated in FIG. 8, wherein the distance between the lines A-A indicates the unstretched condition of the gasket, with the distance between the lines B—B representing the stretched condition. As can be readily understood, the amount of stretching which occurs at the inner radius or surface of the gasket loop in the vicinity of the corner is relatively small, with the stretching which occurs at the outer radius or surface of the loop, near the rib, being substantially greater. Such pre-stressing of the gasket has been found to be very effective in maintaining the gasket in a flat or uniform condition.

Due to the resilience of the oval portion 61, the gasket maintans an expanded shape similar to that shown in FIG. 7 when the window is open, with no signs of curling or buckling. When the pane 20 is closed and latched in place, the oval portion 61 flattens, as shown in FIGS. 2 and 3. Due to the resilience of the gasket and the distortion which occurs, the above construction has been found to be very effective in providing a seal between the pane 20 and the mounting flange 12. Assembly of the gasket is greatly facilitated by the provision of the protruding rib 64 and groove 72, such assembly requiring neither skilled personnel nor special equipment. Should replacement of the gasket ever be required, it can be readily removed by exerting additional force in an outward direction. The force required to remove the gasket, however, is considerably greater than that normally exerted on it under conditions of normal use. Accordingly, it tends to stay in its proper position under the action of the rib, all without requiring special adhesives, cement, or the like.

As shown in FIG. 2, the body of the window includes a screen 76 having a wire or cloth mesh of usual construction, and a peripheral frame 78. The latter can be molded around the mesh, in order to provide a one-piece unit. The screen 76 includes a peripheral flange 80 which is received in a corresponding peripheral groove 82 of the flange 12, the flange 80 and groove 82 constituting a tongue and groove formation for securing the screen 76 to the remainder of the body. In the appended claims, the screen 76 is considered to be part of the body or flange 12.

Figure 4:
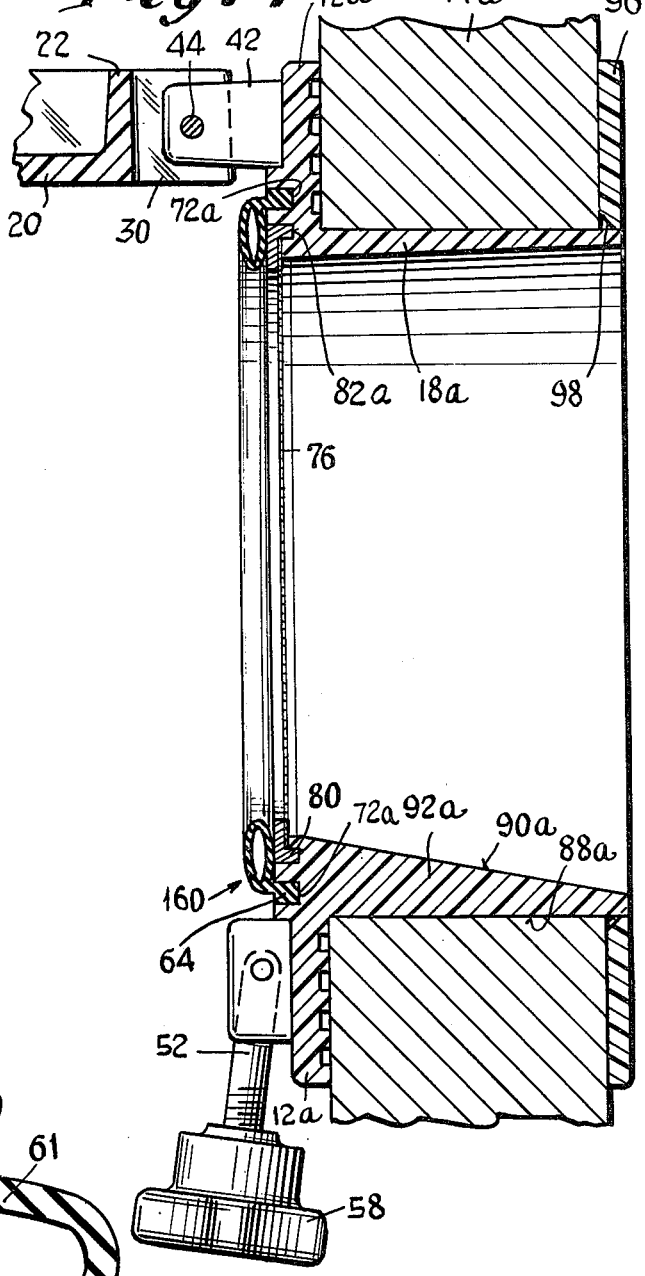
FIG. 4 is a view like FIG. 3, of a modified window construction constituting another embodiment of the invention.

The above construction has the advantage that the assembly of the screen 76 can be readily effected prior to the installation of the gasket 160, by merely dropping the screen in place. Thereafter, the gasket 160 can be installed in the manner indicated above. Following such installation, it can be seen that the screen will be held in position by the gasket 160, even when the pane 20 is swung to its open position. Such a condition is indicated in FIG. 4, illustrating a separate embodiment to be described below.

Referring now to FIG. 3, it can be seen that minimal space around the gasket exists, between the pane 20 and screen frame 78, in which water can be collected or trapped. Improved resistance to leakage is thus realized.

Further in accordance with the invention, the spigot flange 18 has oppositely disposed external all surfaces 86, 88 substantially parallel to one another, for engagement with the hull 14, with one inner wall of the flange having a sloping surface 90 defining a tapered cross-sectional area 92. Such a construction provides drainage of water from all portions of the spigot, by gravity, even when the hull 14 is tilted from the vertical, as during keeling of the boat. The tapered area 92 is preferably integral with the remainder of the spigot, being formed during the molding thereof.

Further in accordance with the invention, and as shown in FIG. 1, the screen frame 78 is provided with a series of drainage passages or weep "holes" 94, 96, 98, 100. Such "holes" are actually in the form of U-shaped cut-outs in the frame 78; they provide for drainage of water toward the sloping surface 90 from the area around the gasket 160. By the provision of the passages 94–100 and sloping surface 90, there is virtually eliminated the possibility of water, (from splashing) being trapped between the pane 20 and gasket 160. In the past, such trapped water has been a problem when the window was opened, resulting in splashing of both personnel and furnishings occupying the interior of the boat. The above construction is seen to largely eliminate this problem.

Figure 5:
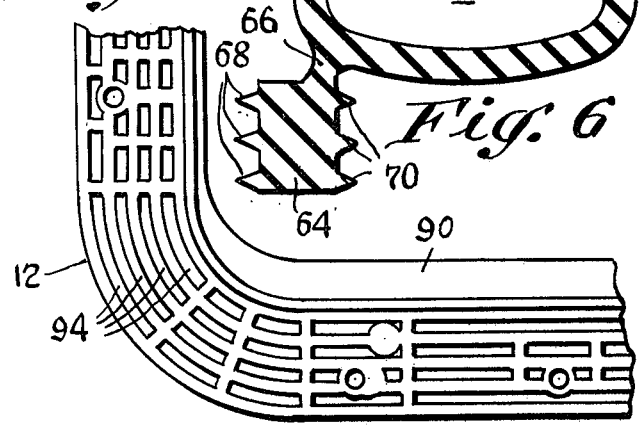
FIG. 5 is a fragmentary rear elevational view of a portion of the mounting flange of the window, particularly showing sealing grooves associated therewith, for improved retention of sealing compound adapted to be employed with the window.

FIG. 5 illustrates the sloping surface 90 of the spigot as well as a series of grooves 94 in the flange 12. The grooves 94 constitute clearance surfaces into which any excess sealing compound can flow. Such compound is employed around the joint between the flange 12 and the hull 14. In addition, the grooved formation provides an improved bonding surface, as can be understood.

Referring again to FIG. 3, a mounting plate 96 is provided, engageable with the opposite surface of the hull 14 and adapted to seal thereagainst. The inner peripheral edge 98 of the plate 96 is beveled as shown in FIGS. 2 and 3, providing a reservoir space. Such a construction has the advantage that during installation, when sealing compound is applied to the underside of the plate 96 and to the outer surface 86, 88 of the spigot flange, the compound tends to be forced against the flanges as the plate is installed, rather than being scraped from the surface as would be the case were the inner peripheral edge perfectly square. An improved seal between the surfaces 86, 88 and plate 96 thereby results.

The knob 58 is seen to include a central raised portion 100 which constitutes a centering means for the knob 58 between the lugs 60, 62 of the pane 20. Such a construction has been found to improve the operation of the latches, by reducing the tendency of the swivel pin 52 to become seated in a position which is eccentric with respect to the U-shaped opening formed by the lugs 60, 62.

Another embodiment of the invention is illustrated in FIG. 4, wherein like reference numerals indicate similar parts, and wherein corresponding parts having slightly modified structures are indicated by numerals having the suffix "*a*." The boat window shown therein comprises a body or mounting flange **12*a* which is secured to a boat hull 14*a* of increased thickness, and an enlarged spigot 18*a* having an increased depth and being capable of extending through the entire thickness of the hull 14*a*. A mounting plate 96 is disposed on the opposite side of the hull 14*a*, including a beveled portion 98** as in the previous embodiment.

The mounting flange **12*a* includes a peripheral groove 72*a* into which the gasket 160 is pressed. A screen 76 substantially identical to that of the first embodiment covers the opening formed by the spigot 18*a*. This includes a flange 80 which is received in a peripheral groove 82*a* adjacent to the groove 72*a* on the flange 12*a*. The latch mechanism comprising the knob 58 and swivel arm 52 are the same as those of the first embodiment, as is the transparent window pane 20 and hinge mechanism associated therewith. One wall 90*a* of the spigot flange is tapered as shown in FIG. 4 which, together with the external flange wall 88*a*, defines a sloping cross-sectional area 92*a*. Such an arrangement has the same advantage as that of the construction shown in FIG. 3, namely that any water which is splashed onto the area within the spigot and adjacent the gasket 160 will be channeled by gravity down the surface 90*a*. Little space exists in the vicinity of the screen 76 and gasket 160** for water to become trapped, and as a consequence there is a tendency for less water to spill into the boat when the window is initially opened.

Figure 11:
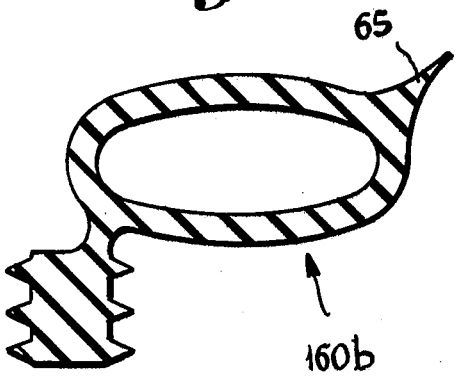
FIG. 11 is a cross-sectional view of a modified sealing gasket which can be employed in the window construction of FIG. 10.
Figure 10:
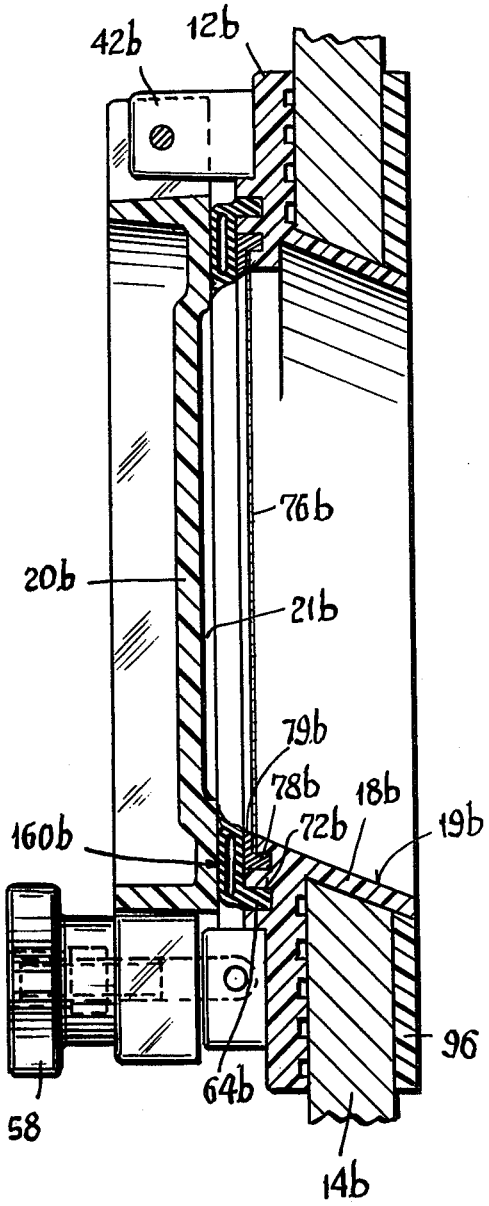
FIG. 10 is a view like FIG. 3, of a further modified window construction, constituting another embodiment of the invention.

Another embodiment of the invention is illustrated in FIGS. 10 and 11, wherein like reference numerals indicate similar parts, and wherein corresponding parts having slightly modified structures are indicated by the numerals having the suffix "*b*". The boat window of FIG. 10 is seen to include a body or mounting flange 12*b* and a spigot **18*b* having two pairs of opposite walls, one pair of said walls being angularly disposed or skewed with respect to the plane of the body 12*b*. The window is shown mounted in a boat hull 14*b* having an opening whose walls are also angularly disposed to thereby receive the walls of the spigot 18*b*. As in the previous embodiment, a mounting plate 96** engages the opposite side of the hull.

A peripheral groove **72*b* in the surface of the flange 12*b* receives the rib 64*b* of a somewhat modified gasket 160*b*, particularly shown in FIG. 11. The gasket 160*b* is substantially the same as the gasket 160 with the exception of a thin, web-like extension or feeler 65 which is integral therewith, and which engages a flat surface of the pane 20*b* in the manner of FIG. 10 when the window is closed. The feeler has a thin edge, as shown. While the pane 20*b* is shown as having a slight recess 21*b* in its outer surface, this is not necessary for the proper operation of the window, and a pane such as that shown in FIG. 2 and designated by the numeral 20, having a perfectly plane surface, could be used with equally good results. All that is required is that the portion of the pane which engages the gasket 160*b*** have a substantially flat area to assure a reasonably good seal.

In FIG. 10, a window screen **76*b* is provided, having a peripheral frame 78*b* with a sloping inner surface 79*b*. Assuming that the parts are arranged as shown in FIG. 10, wherein the surface 79*b* of the screen constitutes a continuation of the sloping surface 19*b* on the inner wall of the spigot, and wherein the inner diameter of the gasket 160*b* is just slightly less than the inside diameter 79*b*, there will be formed a substantially continuous drainage surface from the dished part of the pane 20*b* outwardly to the lowermost point of the surface 19*b***. Such a construction will provide continuous drainage of water which is splashed into the vicinity of the window, with virtually no spaces being available in which water might become trapped.

As in the previous embodiment, the pane 20*b* is carried on a hinge 42*b*, and secured by a latching knob 58. Where a web or feeler 65 is employed, the window can be so arranged to result in less compression of the gasket 160*b* than was the case in the previous embodiments. This is readily effected by increasing the dimension of the hinge 42*b* such that the pane 20*b* will be set out slightly from the body 12*b* when the window is closed.

Figure 9:
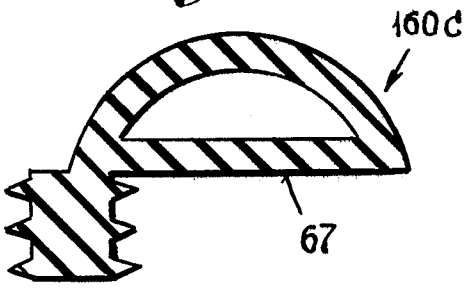
FIG. 9 is a cross-sectional view of a modified sealing gasket adapted for use with the windows previously disclosed, constituting another embodiment of the invention.

FIG. 9 shows a somewhat modified gasket construction 160*c* adapted to be substituted for the gaskets 160 or 160*b*. As illustrated, the gasket 160*c* has a substantially flat surface 67, as well as a semi-circular portion as shown, for improved seating on the body 12*b*. This may be desirable for certain applications. In order respects, the operation of the windows disclosed would be substantially the same if such a gasket shape were employed.

From the above, it can be seen that I have provided a novel and improved window which is exceedingly simple in construction, yet reliable in use. The plastic components can be readily molded, and the gasket manufactured in the form of an extrusion. A suitable substance for the pane 20 has been found to be polycarbonate; suitable material for the frame and spigot portions has been found to be that known as plexiglass DR.

Problems of leakage and deterioration of the seals as associated with prior window constructions are largely eliminated by the above organizations. The device is thus seen to represent a distinct advance and improvement in the technology of boating accessories.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention, and certain portions of the invention may be used without other.

I claim:

1. A self-draining, leak-resistant boat window, comprising in combination:

(a) a frame body comprising a continuous mounting flange for engagement with an inner surface surrounding an opening in the wall of a boat, (b) said body including a spigot connected with said flange and defining the window opening and having a lower portion with an upwardly facing drain surface constituting a sill, said spigot being adapted to extend through said wall opening of the boat, (c) a transparent window pane for closing off the window opening formed by the spigot, (d) means hingedly connecting said window pane to said mounting flange, (e) cooperable latch means on said flange and pane, for securing the latter in a closed position, (f) means defining a peripheral groove in said mounting flange, and (g) a gasket carried by the mounting flange and engageable with peripheral portions of the window pane when the latter is in the closed position, (h) said gasket having a yieldable portion adapted to flatten in cross-section when the pane engages it, (i) said gasket further including protruding means receivable in the peripheral groove in said mounting flange, said frame body having a removable window screen frame, portions of which are interposed between the spigot and the yieldable portion of said gasket, (j) the yieldable portion of said gasket overlying at least parts of said screen frame and holding the latter in position, (k) upper surfaces of the yieldable portion of the gasket and of the screen frame being disposed at a level above the surface of said sill, whereby water splashed thereon and against the window pane can drain by gravity from the vicinity of the yieldable portion of the gasket and from the vicinity of the window pane outwardly and in directions away from said pane.

2. The invention as defined in claim 1, wherein:

(a) the yieldable portion of said gasket has a generally oval cross-section when not engaged by said pane, (b) said oval section flattening when engaged by the pane to form a watertight seal therewith when the pane is closed.

3. The invention as defined in clam 1, wherein:

(a) said frame body has inner peripheral portions juxtaposed to the inner surfaces of the spigot, (b) said gasket, when flattened, having portions closely juxtaposed to said inner surfaces of the spigot and to said inner peripheral portions of the frame body, thereby to prevent the collection of water within said frame body when the pane is closed.

4. The invention as defined in claim 1, wherein:

(a) said transparent window pane has a flush, planar exterior surface, portions of which engage said gasket.

5. The invention as defined in claim 4, wherein:

(a) said transparent window pane has a peripheral strengthening rib on its inner surface, to maintan the exterior surface flat and planar.

6. The invention as defined in claim 1, wherein:

(a) said gasket is continuous and includes a feeler portion having a thin edge for engagement with the peripheral portions of the window pane, (b) said feeler portion providing for drainage of water splashed onto the pane, and constituting a tight seal therewith when the window is closed, (c) said window pane being dished at its outer surface, (d) said feeler portion being adapted to catch water from the edge of said dish and channel it toward the spigot.

7. The invention as defined in claim 6, wherein:

(a) said gasket, feeler and spigot form essentially a continuous drainage surface for channeling water from the pane toward the spigot.

8. The invention as defined in claim 1, wherein:

(a) said sill has a portion which is sloped with respect to the plane of the mounting flange, to provide for improved drainage of water in directions away from the window pane.

9. The invention as defined in claim 8, wherein:

(a) said sloped portion of the spigot has a tapered cross-section.

10. The invention as defined in claim 8, wherein:

(a) said sloped portion of the spigot has a substantially uniform thickness and is disposed askew with respect to the window pane.

11. A self-draining, leak-resistant boat window, comprising in combination:

(a) a frame body comprising a continuous mounting flange for engagement with an inner surface surrounding an opening in the wall of a boat, (b) said body including a spigot connected with said flange and defining the window opening, said spigot being adapted to extend through said wall opening, (c) a transparent window pane for closing off the window opening formed by the spigot, (d) means hingedly connecting said window pane to said mounting flange, (e) cooperable latch means on said flange and pane, for securing the latter in a closed position, (f) means defining a peripheral groove in said mounting flange, (g) a gasket carried by the mounting flange and engageable with peripheral portions of the window pane when the latter is in the closed position, (h) said gasket having a yieldable portion adapted to flatten in cross-section when the pane engages it, (i) said gasket further including protruding rib means receivable in the peripheral groove in said mounting flange, (j) said frame body including a removable window screen frame, (k) means on said frame body defining a shoulder against which the screen frame can seat, and (l) means defining a plurality of drainage passages in said screen frame, for channeling water lying adjacent the gasket toward the spigot and out through the window opening defined thereby.

12. The invention as defined in claim 11, and further including:

(a) cooperable means on said shoulder and on said screen frame defining a tongue and groove formation, for preventing warping of the screen frame and for improving the seating thereof on the shoulder.

13. A self-draining, leak-resistant boat window, comprising in combination:

(a) a frame body comprising a continuous mounting flange for engagement with an inner surface surrounding an opening in the wall of a boat, (b) said body including a spigot connected with said flange and defining the window opening, said spigot being adapted to extend through said wall opening, (c) a transparent window pane for closing off the window opening formed by the spigot, (d) means hingedly connecting said window pane to said mounting flange, (e) cooperable latch means on said flange and pane, for securing the latter in a closed position, (f) means defining a peripheral groove in said mounting flange, (g) a gasket carried by the mounting flange and engageable with peripheral portions of the window pane when the latter is in the closed position, (h) said gasket having a yieldable portion adapted to flatten in cross-section when the pane engages it, (i) said gasket further including protruding rib means receivable in the peripheral groove in said mounting flange, (j) a mounting plate engageable with wall portions of the spigot and adapted to engage the outer surface of said boat wall, (k) said plate having a large central opening into which the spigot can extend when the window is installed, said opening being defined by an inner peripheral edge of the plate, (l) said inner peripheral edge having a beveled surface which, together with the wall portions of the spigot, defines a reservoir space which can accommodate sealing compound employed to secure the plate in position, (m) said beveled surface tending to force said compound against the spigot wall as the plate is installed, thereby providing an improved seal between the latter and the spigot.

14. A self-draining, leak-resistant boat window, comprising in combination:

(a) a frame body comprising a continuous mounting flange for engagement with an inner surface surrounding an opening in the wall of a boat, (b) said body including a spigot connected with said flange and defining the window opening, said spigot being adapted to extend through said wall opening, (c) a transparent window pane for closing off the window opening formed by the spigot, (d) means hingedly connecting said window pane to said mounting flange, (e) cooperable latch means on said flange and pane, for securing the latter in a closed position, (f) means defining a peripheral groove in said mounting flange, and (g) a gasket carried by the mounting flange and engageable with peripheral portions of the window pane when the latter is in the closed position, (h) said gasket having a yieldable portion adapted to flatten in cross-section when the pane engages it, and forming a continuous and generally rectangular loop with rounded corners surrounding said window opening, said yieldable portion constituting an inner part of said loop, (i) said gasket further including protruding rib means receivable in the peripheral groove in said mounting flange, (j) said rib means being disposed along outer parts of said yieldable portion, (k) said gasket being under continual tensile stress and the outer parts of said yieldable portion being stretched more than the inner parts thereof such that there is minimized buckling of the inner parts at the locations of the corners of said rectangular loop, (l) said gasket being maintained under said continual tensile stress by the frictional engagement of the rib means and the walls of said peripheral groove.

15. The invention as defined in claim 14, wherein:

(a) said frame body has a removable window screen frame, portions of which are interposed between the spigot and the yieldable portion of the gasket, (b) the yieldable portion of the gasket overlying at least parts of said screen frame and holding the latter in position.

16. The invention as defined in claim 14, wherein:

(a) said spigot comprises oppositely disposed upper and lower walls which are substantially parallel to one another, and skewed with respect to the plane of the window pane when the latter is closed, (b) the lower one of said walls constituting a drain surface for carrying water in directions away from said pane.

* * * * *